US006162121A

United States Patent [19]

Morro et al.

[11] Patent Number: 6,162,121

[45] **Date of Patent: *Dec. 19, 2000**

[54] VALUE WHEEL GAME METHOD AND APPARATUS

[75] Inventors: Stephen W. Morro, Ocean View, N.J.; Anthony J. Baerlocher, Carson City, Nev.; Robert W. Crowder, Jr.; Yin Zin Mark Lam, both of Reno, Nev.

[73] Assignee: International Game Technology, Reno, Nev.

[ * ] Notice: This patent is subject to a terminal disclaimer.

[21] Appl. No.: 09/201,671

[22] Filed: Nov. 30, 1998

Related U.S. Application Data

[63] Continuation-in-part of application No. 09/124,947, Jul. 30, 1998, which is a continuation of application No. 08/620,586, Mar. 22, 1996, Pat. No. 5,788,573.

[51] Int. Cl.[7] ..... A63F 9/24

[52] U.S. Cl. ..... 463/16; 463/26

[58] Field of Search ..... 463/1, 9, 12–13, 463/16, 20, 25–27, 30–31, 36, 40–42; 700/91–93; 273/138.1, 138.2, 139, 143 R, 292–293

[56] References Cited

U.S. PATENT DOCUMENTS

| | | | |
|---|---|---|---|
| 4,448,419 | 5/1984 | Telnaes | 273/143 R |
| 4,572,509 | 2/1986 | Sitrick | 463/31 |
| 4,711,451 | 12/1987 | Pajak et al. | 273/143 |
| 4,805,907 | 2/1989 | Hagiwara | 273/138 |
| 4,837,728 | 6/1989 | Barrie et al. | 364/412 |
| 4,964,638 | 10/1990 | Ishida | 273/138 |
| 4,998,199 | 3/1991 | Tashiro et al. | 364/410 |
| 5,022,653 | 6/1991 | Suttle et al. | 273/85 |
| 5,042,818 | 8/1991 | Weingardt | 273/292 |
| 5,102,134 | 4/1992 | Smyth | 273/138 A |
| 5,188,363 | 2/1993 | Marnell, II et al. | 273/85 |
| 5,209,479 | 5/1993 | Nagao et al. | 273/143 R |
| 5,259,616 | 11/1993 | Bergmann | 273/138 A |
| 5,275,400 | 1/1994 | Weingardt et al. | 273/85 |
| 5,344,144 | 9/1994 | Canon | 273/138 A |
| 5,393,061 | 2/1995 | Manship et al. | 273/143 R |
| 5,409,225 | 4/1995 | Kelly et al. | 273/138 R |
| 5,586,766 | 12/1996 | Forte et al. | 463/12 |
| 5,702,304 | 12/1997 | Acres et al. | 463/29 |
| 5,707,287 | 1/1998 | McCrea, Jr. | 463/27 |
| 5,788,573 | 8/1998 | Baerlocher et al. | 463/16 |
| 5,823,874 | 10/1998 | Adams | 463/17 |
| 5,848,932 | 12/1998 | Adams | 463/28 |
| 5,851,148 | 12/1998 | Brune et al. | 463/25 |
| 5,934,998 | 8/1999 | Forte et al. | 463/12 |

FOREIGN PATENT DOCUMENTS

| | | | |
|---|---|---|---|
| 48825/85 | 10/1985 | Australia | G07F 17/34 |
| 632454 | 12/1992 | Australia | A63F 9/22 |
| 5-131044 | 5/1993 | Japan . | |
| 2 086 632 | 5/1982 | United Kingdom | G07F 17/34 |
| 2 182 186 | 5/1987 | United Kingdom | G07F 17/34 |
| 2 201 821 | 9/1988 | United Kingdom | G07F 17/34 |

OTHER PUBLICATIONS

Translation PTO–97–0524 Of JP5–131044, 17 pages, 1996.

Advertisement from the SUN newspaper; Tuesday, Mar. 18, 1986; p. 27 to show date and undated advertisement for Commodore 30 cigarettes featuring a gaming machine.

'Old idea make new ideas', *Loose Change*, Sep. 1996, pp. 22–24.

*Primary Examiner*—Mark A. Sager

*Attorney, Agent, or Firm*—Sheridan Ross P.C.

[57] ABSTRACT

A computer-implemented game includes a wheel of fortune portion. The wheel is positioned in a location spaced from the main game housing. In this way even relatively large wheels can be provided without undesirable dimensional enlargement of the main housing.

19 Claims, 9 Drawing Sheets

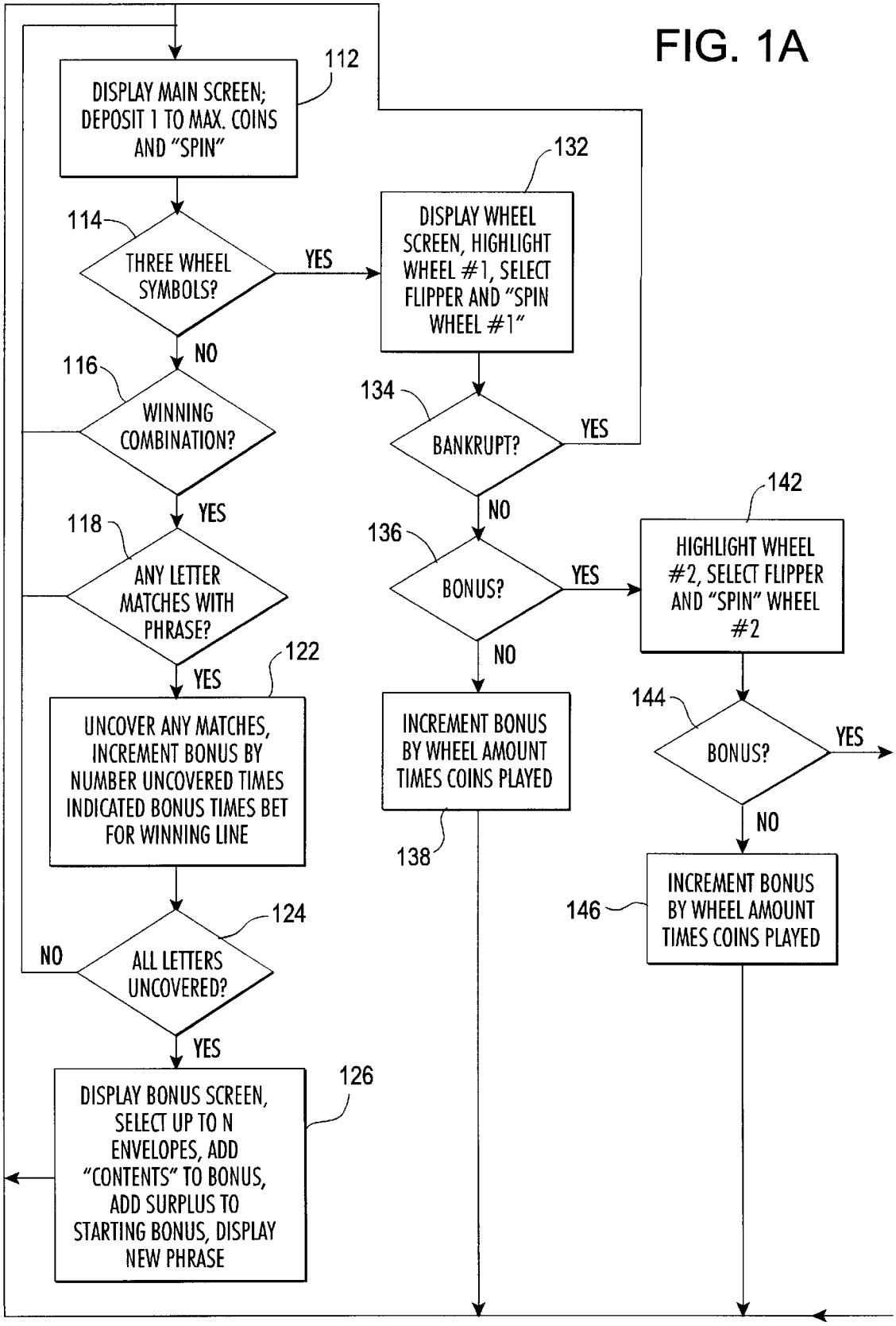
FIG. 1A
112
DISPLAY MAIN SCREEN; DEPOSIT 1 TO MAX. COINS AND "SPIN"
114
THREE WHEEL SYMBOLS?
YES
NO
132
DISPLAY WHEEL SCREEN, HIGHLIGHT WHEEL #1, SELECT FLIPPER AND "SPIN WHEEL #1"
116
WINNING COMBINATION?
YES
134
BANKRUPT?
YES
NO
118
ANY LETTER MATCHES WITH PHRASE?
YES
136
BONUS?
YES
NO
142
HIGHLIGHT WHEEL #2, SELECT FLIPPER AND "SPIN" WHEEL #2
122
UNCOVER ANY MATCHES, INCREMENT BONUS BY NUMBER UNCOVERED TIMES INDICATED BONUS TIMES BET FOR WINNING LINE
INCREMENT BONUS BY WHEEL AMOUNT TIMES COINS PLAYED
138
144
BONUS?
YES
NO
146
INCREMENT BONUS BY WHEEL AMOUNT TIMES COINS PLAYED
124
ALL LETTERS UNCOVERED?
NO
YES
126
DISPLAY BONUS SCREEN, SELECT UP TO N ENVELOPES, ADD "CONTENTS" TO BONUS, ADD SURPLUS TO STARTING BONUS, DISPLAY NEW PHRASE

VALUE WHEEL GAME METHOD AND APPARATUS

The present invention is a continuation-in-part of U.S. patent application Ser. No. 09/124,947 filed Jul. 30, 1998 which is a continuation of U.S. patent application Ser. No. 08/620,586 filed Mar. 22, 1996 for "Electronic Game Method and Apparatus with Heirarchy of Simulated Wheels", now U.S. Pat. No. 5,788,573, both of which are incorporated herein by reference. Cross-reference is made to U.S. patent application Ser. No. 09/026,060 filed Feb. 14, 1998 for "Prize Indicator for a Gaming Device", incorporated herein by reference.

The present invention relates to an electronically implemented gaming device and in particular to a computer implemented "Wheel of Fortune" game.

BACKGROUND INFORMATION

Among various devices which have been used for gaming, even before the electronic age, is a wheel of fortune which typically involves a disk or wheel rotatable in a vertical plane with a plurality of numbers, symbols or other indicia positioned on the face of the wheel near its perimeter. A stationary pointer, such as a flexible resilient flipper, is configured to point to an indicium when the wheel is stationary. In one use, players place wagers on which indicium the flipper will point to when the wheel comes to rest after having been manually spun.

A number of games incorporating a wheel of fortune have been devised, including a televised game titled "Wheel of Fortune" which combines a spin of a wheel of fortune with players' attempts to complete and/or guess at a hidden phrase by choosing, winning or buying letters of the alphabet which are revealed to the players if contained in the hidden phrase.

SUMMARY OF THE INVENTION

The present invention includes a recognition of problems found in previous devices.

When a game is provided which includes one or more value fields as part of the game or prize display, many previous approaches have involved positioning such wheel in the main game terminal housing leading to relatively tall or otherwise large-dimensioned gaming terminal main housings. For example, the size or dimension of a main gaming terminal housing which is feasible for a particular implementation may be limited by considerations of vertical or horizontal casino space available for a given number of terminals, visibility requirements for constraint (e.g., for purposes of achieving adequate supervision in a casino) casino theme or appearance, constraints and the like. Size requirements for the main terminal housing in previous approaches was particularly troublesome when the value wheel had a relatively large number of wheel sections or other indicia requiring, in order to preserve indicium legibility, a relatively large wheel diameter. Additionally, configurations in which value wheels or similar game or prize displays are positioned in the main gaming terminal housing, made it difficult to achieve wide visibility or effective attraction functions for such value wheels or other displays without resulting in main gaming terminal housings that were excessively tall. Such constraints on the main gaming terminal housing size were additionally troublesome when the main gaming terminal needed to provide other types of displays, controls, inputs and the like, such as a display for a different portion of the game or prize indication, such as including, in addition to a value wheel, an indicator such as slot-machine reels, a separate LCD display and the like. Accordingly, it would be useful to provide a gaming process or apparatus involving a value wheel which can be provided without an excessively-dimensioned main gaming terminal housing.

When a game was configured with first and second game and/or prize display portions, (such as providing a slot machine/simulated card game, keno game or other first win/loss or prize display device) in addition to a value wheel display, it was, in many previous configurations, troublesome to provide the ability to update, revise or otherwise change the games such as by changing the theme or type of the game or prize display. For example, if a value wheel is to be positioned in a main housing which also includes, for example, a slot machine reel section, in order to change the theme of the value wheel portion of the game (either to a wheel having a different theme or appearance or to a portion of the game or prize display which does not involve a value wheel) it would, in many previous devices, be necessary to replace or modify the main game terminal housing to accommodate a different type of value wheel or a display different from a value wheel. Furthermore, many gaming regulatory agencies impose restrictions on win/loss determination procedures in a gaming terminal which are much more strict than those pertaining to, merely, a display or theme portion of a gaming terminal. Accordingly, it would be advantageous to provide a gaming apparatus or procedure in which changing the theme, appearance, prize display or similar features of the game can be accomplished without the need to modify or replace the main game housing and/or without the need to modify win/loss determination procedures (such as random number generation procedures when these are used for determining whether a round of play results in a win or loss and/or the amount or prize associated with a win).

In many previous approaches, gaming terminals were designed or constructed on an individual basis. When it is desired to include one or more value wheels in connection with gaming terminals, individual gaming terminal design has not been particularly conducive to providing a unified appearance over a region of a casino or other gaming area. Accordingly, it would be advantageous to provide a configuration in which one or more value wheels were associated with a plurality of gaming terminals.

One of the problems with a traditional wheel of fortune is that the number of possible indicia (and thus the maximum possible odds of winning) are limited by the physical size of the wheel. In some gaming environments, it is desired to provide a game which permits relatively small wagers but provides a potential for relatively large prizes. The popularity of so-called progressive games demonstrates the attractiveness of this type of gaming environment. However, the combination of small wagers and large prizes typically means that the odds of winning based on any one wager must be small, such as one in one million, more preferably one in five million, and even more preferably one in eight million or more. Previous traditional wheel of fortune games are not capable of providing these types of odds.

Accordingly, in one embodiment it would be advantageous to provide a game which incorporates features of a traditional wheel of fortune game but which is compatible with small prize odds such as odds of one in one million or more.

According to one embodiment of the invention, rather than providing an actual physical wheel, an electronic image of a wheel, preferably a video image controlled by a computer, is provided. Preferably, as with the traditional physical wheel of fortune, the ending configuration of the simulated wheel, after any one spin, is a random event. However, unlike a traditional, physical wheel of fortune in which the ending position, is determined by physical factors such as starting position, rotational velocity, friction, and the like, randomness in the simulated wheel is provided by a computer process such as a random number generator or pseudo-random number generator. In one embodiment, the image of the simulated wheel, just as with a traditional physical wheel, is provided with a plurality of indicia. Unlike the traditional wheel, however, in which the wheel indicia are provided with predetermined, typically even, spacing, such that odds of landing on any given indicium are determined by the total number of indicia, in one embodiment of the present invention, odds are determined by the number of integers in a first range of integers mapped to the indicia. The number of integers in the first range may be different from the number of indicia on the simulated wheel. For example, in an evenly spaced physical wheel with 24 indicia, the odds of landing on any one indicium would be 1 in 24. However, in the present invention, even if the simulated wheel has 24 indicia which are evenly spaced, the odds of landing on any given indicium are determined by the size of the integer range mapped to the wheel and the number of integers mapped to any given indicium on the simulated wheel and thus may be different from 1 in 24.

In another embodiment, it may be desired to change, replace or otherwise modify indicia on a simulated wheel, e.g., during the spinning of the simulated wheel. In this way, even though it may be desired to provide only N indicium locations on the simulated wheel, the simulated wheel may be provided with m possible indicia by "swapping" new indicia onto the wheel during simulated spinning.

It should be understood that it is possible to use physical wheels for implementing the game of this invention. A physical wheel would require a corresponding virtual wheel in the computer memory of the machine. The number of positions in the virtual wheel is equal to or exceeds the number of positions on the physical wheel. The virtual positions are then mapped to the physical wheel positions permitting the odds of hitting a particular physical position to change without changing the size of, or number of physical positions on the wheel. The virtual wheel is analogous to the virtual reel invention disclosed in U.S. Pat. No. 4,448,419 to Telnaes and assigned to International Game Technology. For purposes of this application, the use of the term simulated wheel or video screen wheel shall include physical wheels having corresponding virtual wheels in the computer memory of the device.

Traditional wheels of fortune were provided as isolated devices wherein the outcome of one wheel was unrelated to the operation of another wheel. In one embodiment of the present invention, a wheel which provides the potential for winning a large or jackpot prize can only provide such a win if the player has previously achieved a predefined result on a previous spin of another wheel. In one embodiment, the previous wheel need not provide an opportunity for a jackpot win. In this situation, the odds of winning a grand prize or jackpot on the second wheel spin is the product of the odds of landing on a jackpot-indicating indicium on said second simulated wheel times the odds of obtaining the predefined result on the previous wheel, providing a hierarchy of wheels of fortune wherein the result from one wheel spin has an effect on the other wheel spin. Thus, in one embodiment, a game provides for two or more different wheel spins in order to win a grand prize, providing odds of winning the grand prize which is a product of odds on two or more different spins and thus diminishing the overall odds.

DETAILED DESCRIPTION OF THE PREFERRED EMBODIMENTS

The present invention involves an electronically-implemented game method and apparatus, preferably a computer-implemented game. It is anticipated that a game according to the present invention will be played in a context in which monetary wagering is involved, typically in a casino or similarly regulated environment. As will be clear to those of skill in the art, the game can also be played in other environments such as personal computer (PC) game playing, video arcade environments, networked or other remote environments including Internet environments, local area networks, wide area networks and the like, and can involve either monetary wagering, wagering using physical or electronic tokens, credits and the like, or play without wagering such as for amusement purposes.

In one embodiment, the game is implemented on an electronic gaming terminal which includes a programmable controller or computer. The computer may be coupled to various output devices preferably including a display screen for displaying aspects of the game as described more thoroughly below. Other output devices may include audio outputs such as speakers, bells, whistles and the like, and signaling devices such as controllable lights and the like. A number of types of input devices can be used by which the user can place wagers and/or play the game, including touch screen input devices, joysticks, mouse input devices, keyboards, buttons, levers and the like, as well as coin or currency acceptors and/or validators, card readers such as credit card readers, or other encoded-card readers. In one embodiment, gaming terminals may be provided with communication devices, e.g., for purposes for accounting, maintenance, management, security, controls, updating and the like. It is common in the gaming industry to provide for electronic gaming terminals and those with skill in the art will understand how to construct and program such gaming terminals to implement the game according to the present invention after reading and understanding the present description.

Figure 7:
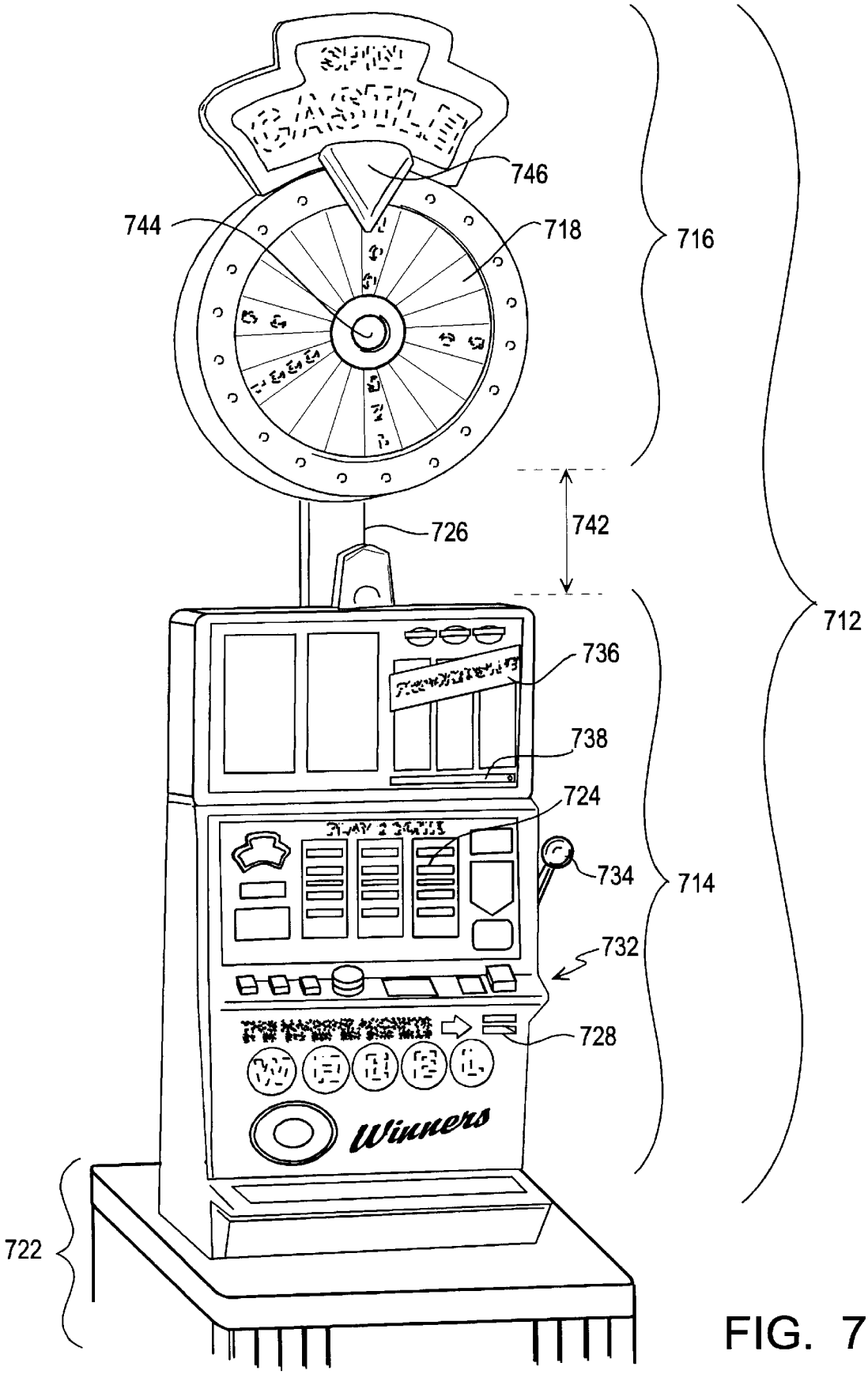
FIG. 7 is a front elevational view of a gaming terminal according to an embodiment of the present invention.

In the embodiment of FIG. 7, a gaming terminal 712 includes a main gaming terminal housing or lower portion 714 and an upper portion 716 including a value wheel 718. The gaming terminal 712 may rest on a stand or pedestal 722. In the depicted embodiment, the lower portion 714 is configured as a slot machine and, preferably, the lower portion 714 can use, with a need for no more than relatively minor modifications, any of a number of previous slot machines such as previous electronic or computer-controlled slot machines including those available from International Game Technology of Reno, Nevada. Modifications to previous slot machines for use in accordance with embodiments of the present invention can include, e.g., providing graphics, instructions, prize indications and the like to inform players how to play the game, provision of one or more displayable or highlightable indicia, such as indicia on one or more of the reels of the slot machine 724 for indicating play or display of the value wheel 718 and provisions for outputting signals from the lower portion 714 to control rotation or other operation of the upper portion 716, e.g., via cables, fiber optics, buses, wireless links or other communication links. In the embodiment depicted in FIG. 7, the communication links may be carried in a column 726 which positions and supports the upper portion 716 with respect to the lower portion 714.

In the depicted embodiment, the lower portion 714 contains a number of items commonly found in slot machines such as a bill acceptor 728, a button panel 732 for providing user controls such as spin, bet, payout and the like, a handle 734, graphics or instructions regarding payouts from various winning combinations and/or instructions or attraction graphics regarding progressive prizes 736 and, preferably a progressive prize display 738. Preferably the upper portion 716 including the value wheel 718 is spaced a distance 742 from the main gaming terminal housing 714. In use, the user places a wager, e.g., via a bill acceptor, coin slot, card reader, button controls, touch screen or the like. In response to any of a number of types of user input, such as pulling the handle 734 or pressing a spin button 732, the reels 724 of the slot machine will rotate and will stop to display an unpredictable, preferably random, combination of reel symbols on the visible portion of the reels 724. In one embodiment, prizes, preferably monetary prizes, are awarded in response to at least some symbol combinations, at least some combinations preferably being associated with predetermined or fixed prizes.

The value wheel 718 may play any of a number of roles in the game, depending on how the game is configured, including embodiments described more fully below. In some embodiments, the value wheel 718 is used at least partially in connection with a win-loss decision, i.e., determining whether a prize will be awarded in response to a round of play (or portion thereof). In this regard, according to one embodiment, a "round" of play includes one slot machine reel spin activity. Those of skill in the art will understand how to coordinate value wheel portions of the game with game portions other than a slot machine (such as games in which the lower portion 714 is provided as a simulated card game, keno game, and the like) after understanding the present disclosure.

In other embodiments, the value wheel 718 is used in determining the size or amount of a prize but may not be used in determining whether a prize is awarded or not, i.e., may not be involved in the win/loss decision. In one embodiment, a predetermined combination of reel symbols 724 indicates that a prize has been won with the amount of the prize to be determined, preferably randomly, using the value wheel 718. In one embodiment, the symbols indicating this type of win depict or are otherwise associated with the value wheel such as resembling the wheel, including the term "wheel" or the like. In one embodiment, the gaming terminal is configured such that, in response to such a predetermined combination of reel symbols, either automatically or after a user pushes a button (such as a wheel spin button 732), the wheel 718 is caused to rotate about its axis 744 (e.g., by activation of a motor) and thereafter stops, preferably at a randomly selected position, with a pointer 746 pointing to a location of the wheel 718 bearing an indicium (such as a numeral) indicating the size of the prize which has been won.

Figure 8:
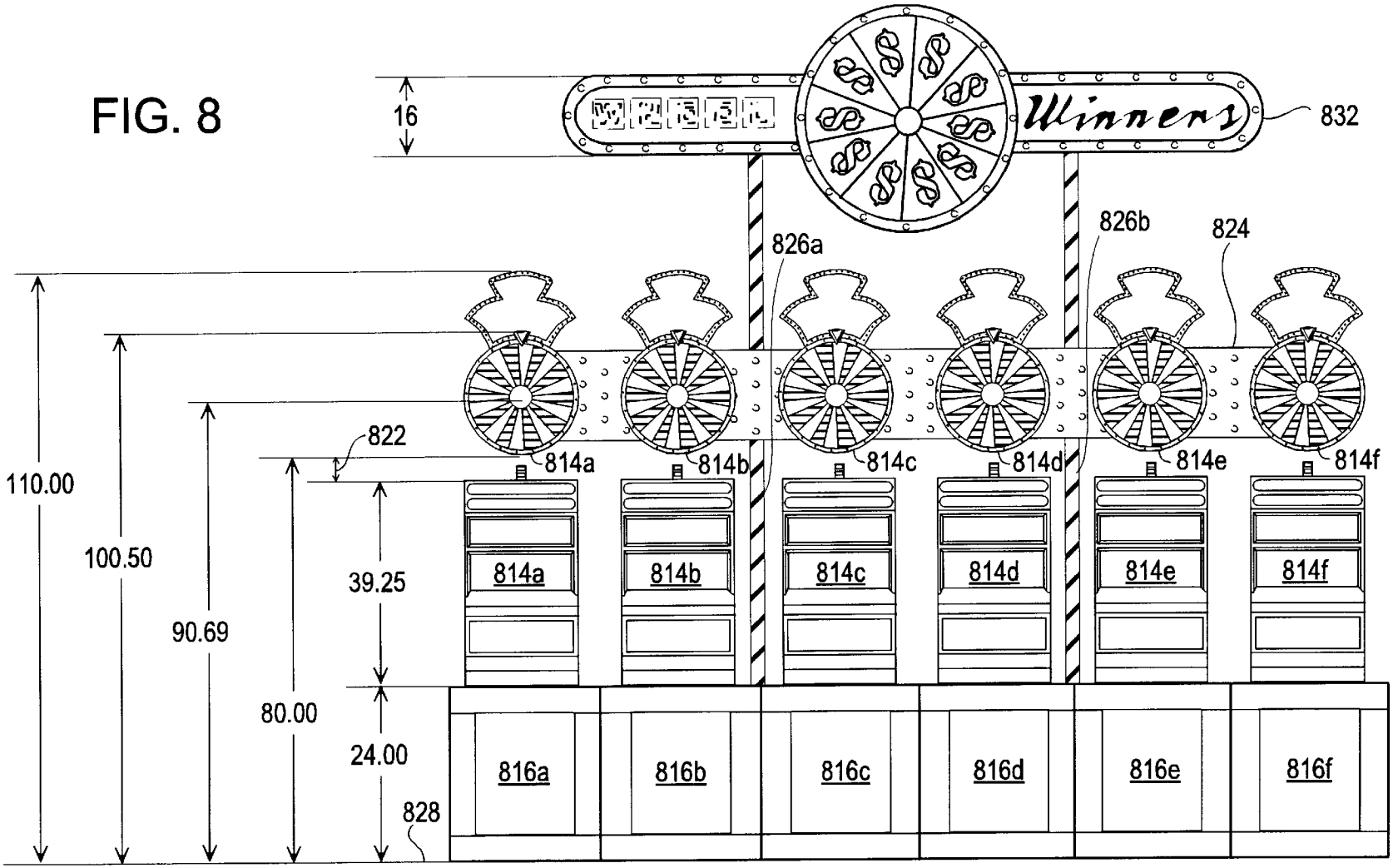
FIG. 8 is a front elevational view of a bank of gaming terminals according to an embodiment of the present invention.

The embodiment of FIG. 8 shows a configuration in which a plurality of gaming terminal main housings 814*a* through 814*f* are positioned in a predefined configuration, preferably adjacent one another in a line. The gaming terminal main housings 814*a* through 814*f* can have any of a number of configurations including a configuration similar to the housing 714 depicted in FIG. 7. In the embodiment of FIG. 8, the main housings 814*a* through 814*f* are positioned on pedestals 816*a*-through 816*f*. At least one and preferably a plurality of value wheels 818*a* through 818*f* are positioned preferably above and aligned with corresponding main housings 814*a* through 184*f*. The value wheels 818*a* through 818*f* may be generally similar to the value wheels 718 depicted in FIG. 7 and may play any of a number of roles in connection with the games, as described above. Preferably the value wheels 818 are spaced a distance 822 above the main gaming terminal housings 814. In the embodiment of FIG. 8, the value wheels 818 are suspended above the main housings 814 by a bar structure 824 and one or more poles 826*a,b* connected to pedestals 816 and/or the floor or support surface 828. In the depicted embodiment, cables or other communication links are provided from gaming terminals 814 to corresponding value wheels 818 via passage ways through the poles 826 and bar 824 and, accordingly, in the depicted embodiment there is no direct structural connection between a value wheel 818 and a corresponding main housing 814 (i.e., no structure corresponding to the column 726 of the embodiment of FIG. 7). If desired, signage or other attractants 832 may be provided such as positioned above the array of value wheels 818. In one embodiment, operation of the game using the terminals of FIG. 8 is substantially the same as that described above in connection with the embodiment of FIG. 7. Although the embodiments of FIGS. 7 and 8 depict a physical value wheel, it is also possible to provide a video display of a simulated value wheel.

In the embodiment of FIG. 7, a gaming terminal 712 includes a main gaming terminal housing or lower portion 714 and an upper portion 716 including a value wheel 718. The gaming terminal 712 may rest on a stand or pedestal 722. In the depicted embodiment, the lower portion 714 is configured as a slot machine and, preferably, the lower portion 714 can use, with a need for no more than relatively minor modifications, any of a number of previous slot machines such as previous electronic or computer-controlled slot machines including those available from International Game Technology of Reno, Nevada. Modifications to previous slot machines for use in accordance with embodiments of the present invention can include, e.g., providing graphics, instructions, prize indications and the like to inform players how to play the game, provision of one or more displayable or highlightable indicia, such as indicia on one or more of the reels of the slot machine 724 for indicating play or display of the value wheel 718 and provisions for outputting signals from the lower portion 714 to control rotation or other operation of the upper portion 716, e.g., via cables, fiber optics, buses, wireless links or other communication links. In the embodiment depicted in FIG. 7, the communication links may be carried in a column 726 which positions and supports the upper portion 716 with respect to the lower portion 714.

In the depicted embodiment, the lower portion 714 contains a number of items commonly found in slot machines such as a bill acceptor 728, a button panel 732 for providing user controls such as spin, bet, payout and the like, a handle 734, graphics or instructions regarding payouts from various winning combinations and/or instructions or attraction graphics regarding progressive prizes 736 and, preferably a progressive prize display 738. Preferably the upper portion 716 including the value wheel 718 is spaced a distance 742 from the main gaming terminal housing 714. In use, the user places a wager, e.g., via a bill acceptor, coin slot, card reader, button controls, touch screen or the like. In response to any of a number of types of user input, such as pulling the handle 734 or pressing a spin button 732, the reels 724 of the slot machine will rotate and will stop to display an unpredictable, preferably random, combination of reel symbols on the visible portion of the reels 724. In one embodiment, prizes, preferably monetary prizes, are awarded in response to at least some symbol combinations, at least some combinations preferably being associated with predetermined or fixed prizes.

The value wheel 718 may play any of a number of roles in the game, depending on how the game is configured, including embodiments described more fully below. In some embodiments, the value wheel 718 is used at least partially in connection with a win-loss decision, i.e., determining whether a prize will be awarded in response to a round of play (or portion thereof). In this regard, according to one embodiment, a "round" of play includes one slot machine reel spin activity. Those of skill in the art will understand how to coordinate value wheel portions of the game with game portions other than a slot machine (such as games in which the lower portion 714 is provided as a simulated card game, keno game, and the like) after understanding the present disclosure.

In other embodiments, the value wheel 718 is used in determining the size or amount of a prize but may not be used in determining whether a prize is awarded or not, i.e., may not be involved in the win/loss decision. In one embodiment, a predetermined combination of reel symbols 724 indicates that a prize has been won with the amount of the prize to be determined, preferably randomly, using the value wheel 718. In one embodiment, the symbols indicating this type of win depict or are otherwise associated with the value wheel such as resembling the wheel, including the term "wheel" or the like. In one embodiment, the gaming terminal is configured such that, in response to such a predetermined combination of reel symbols, either automatically or after a user pushes a button (such as a wheel spin button 732), the wheel 718 is caused to rotate about its axis 744 (e.g., by activation of a motor) and thereafter stops, preferably at a randomly selected position, with a pointer 746 pointing to a location of the wheel 718 bearing an indicium (such as a numeral) indicating the size of the prize which has been won.

The embodiment of FIG. 8 shows a configuration in which a plurality of gaming terminal main housings 814*a* through 814*f* are positioned in a predefined configuration, preferably adjacent one another in a line. The gaming terminal main housings 814*a* through 814*f* can have any of a number of configurations including a configuration similar to the housing 714 depicted in FIG. 7. In the embodiment of FIG. 8, the main housings 814*a* through 814*f* are positioned on pedestals 816*a*-through 816*f*. At least one and preferably a plurality of value wheels 818*a* through 818*f* are positioned preferably above and aligned with corresponding main housings 814*a* through 184*f*. The value wheels 818*a* through 818*f* may be generally similar to the value wheels 718 depicted in FIG. 7 and may play any of a number of roles in connection with the games, as described above. Preferably the value wheels 818 are spaced a distance 822 above the main gaming terminal housings 814. In the embodiment of FIG. 8, the value wheels 818 are suspended above the main housings 814 by a bar structure 824 and one or more poles 826*a,b* connected to pedestals 816 and/or the floor or support surface 828. In the depicted embodiment, cables or other communication links are provided from gaming terminals 814 to corresponding value wheels 818 via passage ways through the poles 826 and bar 824 and, accordingly, in the depicted embodiment there is no direct structural connection between a value wheel 818 and a corresponding main housing 814 (i.e., no structure corresponding to the column 726 of the embodiment of FIG. 7). If desired, signage or other attractants 832 may be provided such as positioned above the array of value wheels 818. In one embodiment, operation of the game using the terminals of FIG. 8 is substantially the same as that described above in connection with the embodiment of FIG. 7. Although the embodiments of FIGS. 7 and 8 depict a physical value wheel, it is also possible to provide a video display of a simulated value wheel.

Figure 1B:
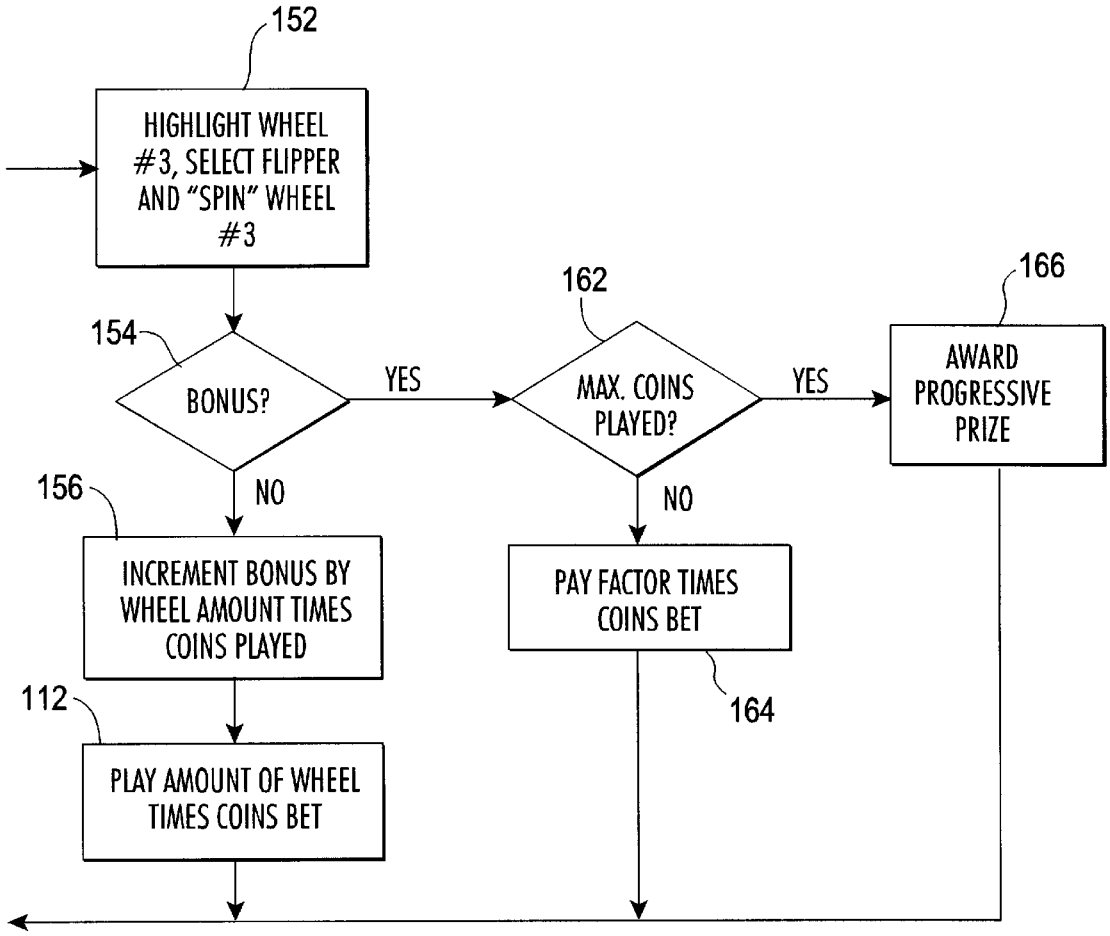
FIG. 1 is a flow chart describing a procedure for a wheel of fortune simulated game according to an embodiment of the present invention.
Figure 2:
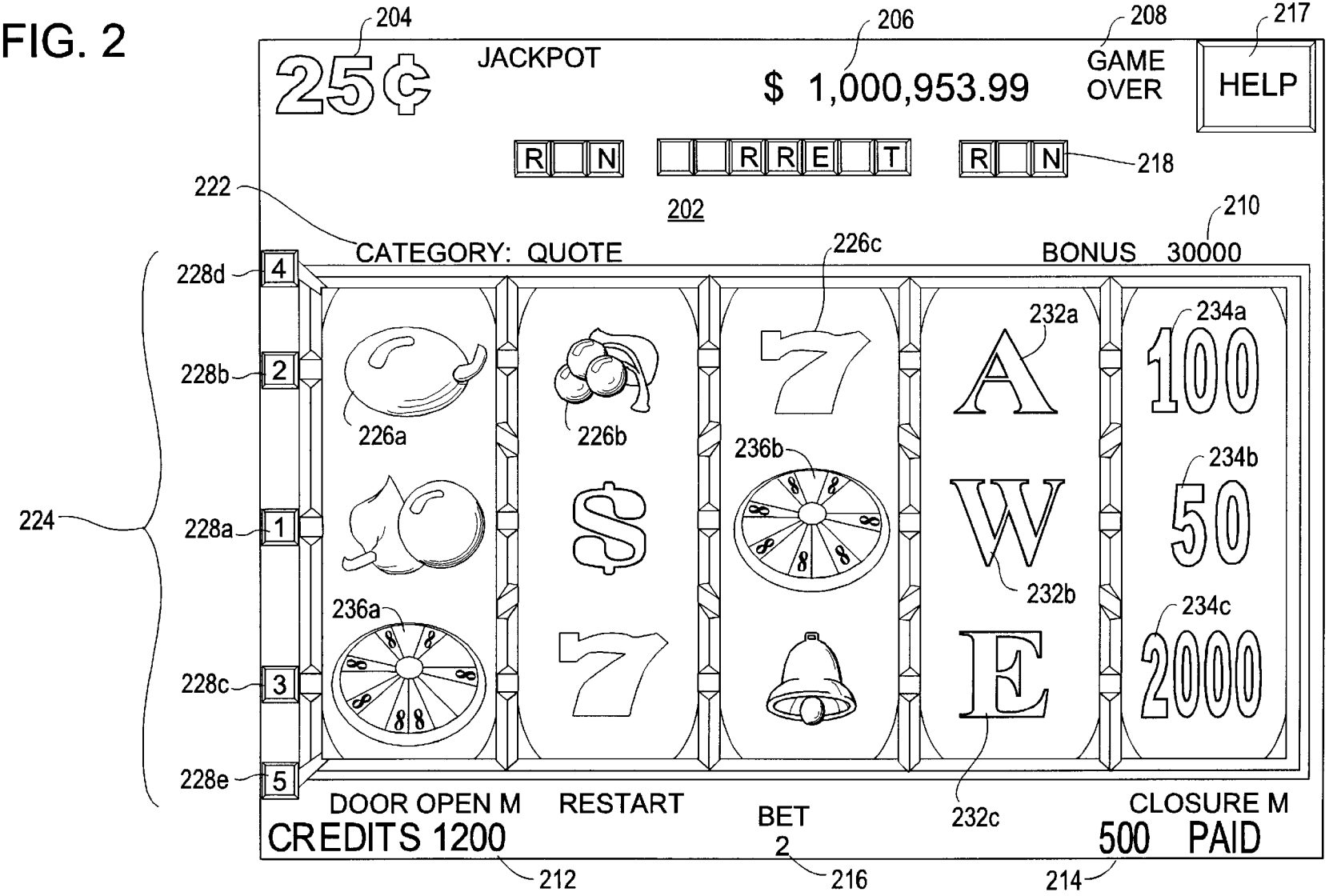
FIG. 2 shows a display screen during the first portion of game play according to an embodiment of the present invention.
Figure 3:
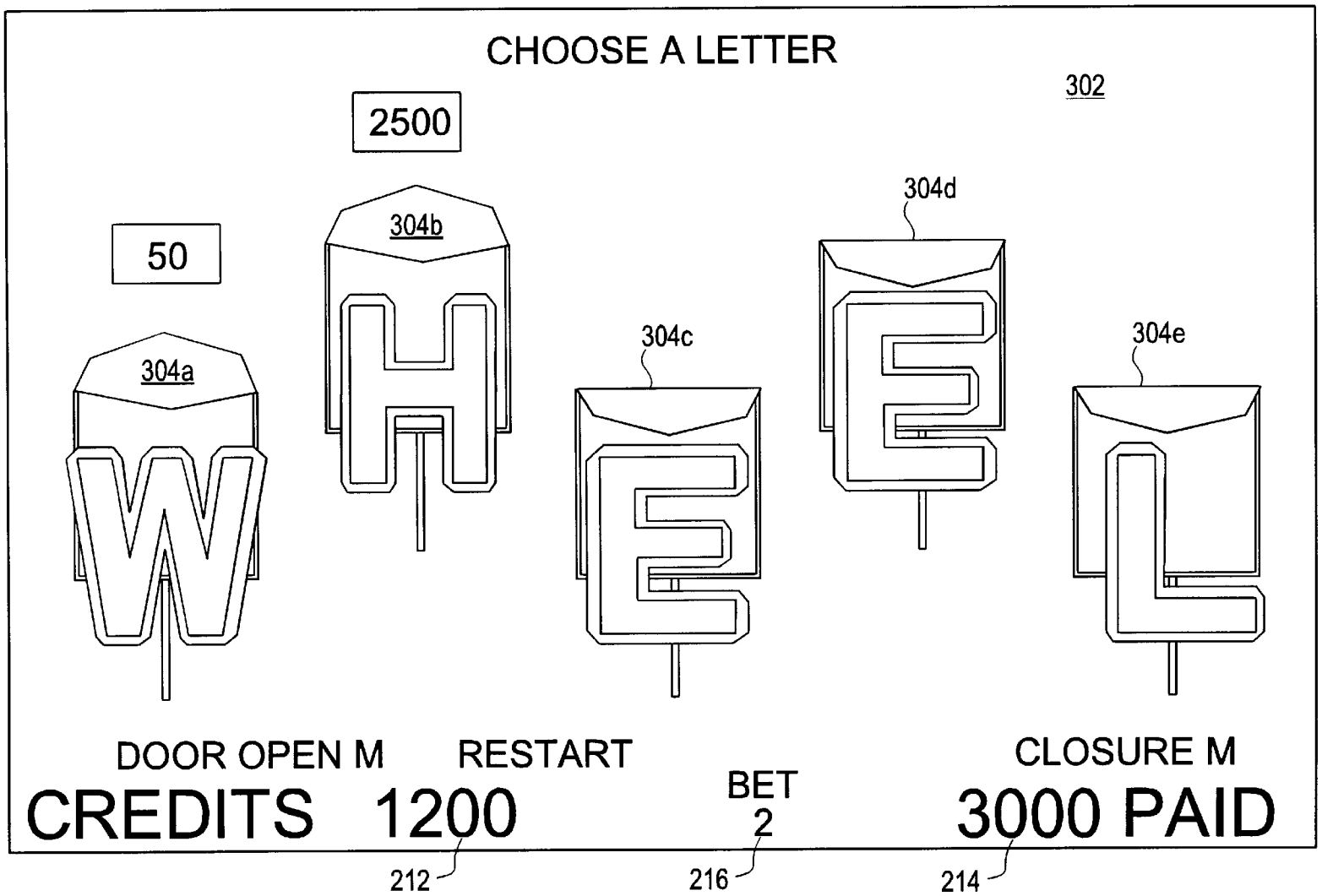
FIG. 3 shows the appearance of a display screen during a second portion of game play according to an embodiment of the present invention.

In another embodiment, as depicted in FIG. 1, game play begins when the gaming terminal is configured to display a main screen 202 (FIG. 2). The main screen may be provided with a number of displays such as a display of the denomination of the machine (i.e., the smallest coin that can be used to play a game on the gaming terminal) 204, the size of the grand prize or jackpot 206, an indication of the current status of the game 208, an indication of the number of bonus points (described below) 210, an indication of the user's current credits 212, the amount paid 214, and an indication of the current or most recent bet, such as the number of coins wagered 216. In one embodiment, bonus points do not have any monetary value but affect play of the game as described below. In one embodiment, a user may activate an input device, such as a first touch screen region 217 to obtain instructions on playing the game or other help.

In the depicted embodiment, the first portion of the game is not a simulated wheel spin game. A number of other types of games can be used for the first portion. In the depicted embodiment, the first portion game is a combination electronic slot machine and puzzle completion game. In this case, the puzzle is a word phrase; however, it could be a picture puzzle or any other type of piece by piece puzzle to be solved. A first area 218 displays regions for each letter in the phrase. In the embodiment which is depicted in FIG. 2, some of the letters are revealed (namely, all of the Rs, Ns, Es and Ts) as a result of previous play (as described below) or possibly as an automatic starting point. In the depicted embodiment, the category of the phrase is displayed 222.

A second portion of the screen 224 shows an area having some similarities to a typical electronic slot machine display, including simulated slot machine reels 226*a*, 226*b*, 226*c* and pay line indicators 228*a*, 228*b*, 228*c*, 228*d*, 228*e*. Each simulated reel region displays various indicia, such as the types of fruit, bell, bar and number symbols commonly found in electronic slot machines. In addition, indicia may be provided for use in determining whether the user may have a chance at a secondary screen video wheel spin, such as wheel indicia 236*a*, 236*b*. Associated with each payline 228 is one of a plurality of letter indicia 232*a*, 232*b*, 232*c*, with a bonus value being associated with each of the letter indicia 234*a*, 234*b*, 234*c*. A user, during display of the main screen 202, may make a wager, e.g., by depositing a coin, currency, credit card, etc. In one embodiment, a minimum number of coins or other monetary units must be deposited in order to play the game as described below. In one embodiment, the user may wager up to a maximum number of coins at a time (MAX). In one embodiment, the player may deposit between 1 and 25 coins. After the user has deposited the maximum number or has indicated (e.g., by a button or touch screen input) that the user has completed making the desired wager, the slot machine portion of the screen 224 will display a simulated slot machine handle pull, i.e., the simulated reels 226*a*, 226*b*, 226*c* (along with reels 226*d*, 226*e*) will appear to spin 112.

After showing a simulated slot machine reel spin, the display 202 will simulate the appearance of slot machine reels that have come to rest, preferably in randomly chosen positions. If, following the reel spin, the results of the slot machine region 224 show at least a predetermined number, such as 3, of wheel indicia 236*a*, 236*b*, the user will be provided with a chance to play a wheel of fortune portion of the game as described more thoroughly below.

If the slot machine portion 224 shows a winning combination, such as three bells aligned along one of the pay lines 228 (or other combinations defined as winning combinations 116), the computer will determine 118 whether any of the letters 232 associated with such winning pay lines match any un-covered letters from the phrase 218. If there are any matches between such letters 232 and the phrase 218, all instances of that letter in the phrase are revealed in region 218. The bonus value 210 is incremented 122 by a number equal to the product of the bonus points 234 associated with that letter 232 times the number of occurrences of that letter 232 in the phrase 218 times the number of coins bet 216 on the particular pay line. In some embodiments, the user may be permitted to place bets associated with different pay lines and in that case the product will be calculated on the basis of the wagers associated with the particular winning pay lines. If, as a result of the most recent slot machine spin, there are still uncovered letters remaining in the phrase 218, the process returns to the beginning of the procedure 112 and the user has an opportunity to place another wager and spin the slot machines wheels.

If all of the letters in the phrase 218 have been uncovered, the display screen is controlled to display a bonus screen 302. The bonus screen 302 permits the user to select from among various regions of the screen, each associated with a point value. In one embodiment, the regions are depicted as envelopes 304*a*–304*e*, and the user is permitted to select (e.g., via a touch screen or other input device) a certain number of envelopes or regions with the points associated with these envelopes or regions being added to the user's bonus value 210. In one embodiment, the number of envelopes or regions which the user can select depends upon how many points 210 the user had accumulated before reaching the bonus screen 302. In one embodiment, the user may select one letter if fewer than 2000 points have been accumulated, two letters for 2000 to 2999 points, three letters for 3000 to 3499 points, 4 letters for 3500 to 3599 points, and five letters for 3600 or more points. These point values may be altered and are set in accordance with the game design as determined by the game designer. Since the phrase 218 has been solved, the procedure returns to the beginning 112 so that the user can, if desired, begin a new game, with a new phrase 218. If the player, during the bonus screen 302, had more points than the minimum number of points needed for the envelopes that were selected, the excess points are used as a starting bonus value 210 for the next game or phrase 218. For example, if the player accumulated 2500 bonus points during the main game (FIG. 2), the player needed only 2000 points as the minimum necessary to select two envelopes. Thus, 500 points will be used as the starting bonus points towards the next phrase 210.

As noted above, preferably one or more results from the first, non-wheel game (FIG. 2) can be used as a "trigger" to permit the user to play a wheel game. In one embodiment, a predetermined number of special wheel symbols 236 must be displayed on the simulated slot machine region 224 in order to have a chance at the wheel game. Preferably the non-wheel game (whether it is a slot machine/phrase game as depicted, or some other game such as poker, other card games, keno, other traditional casino games or a common amusement game), provides a bounded or predetermined probability of having a chance at the wheel game as described below. In one embodiment, the non-wheel game FIG. 2 is configured so that there is a 1:50 chance of reaching the point where a wheel game may be played.

Figure 4:
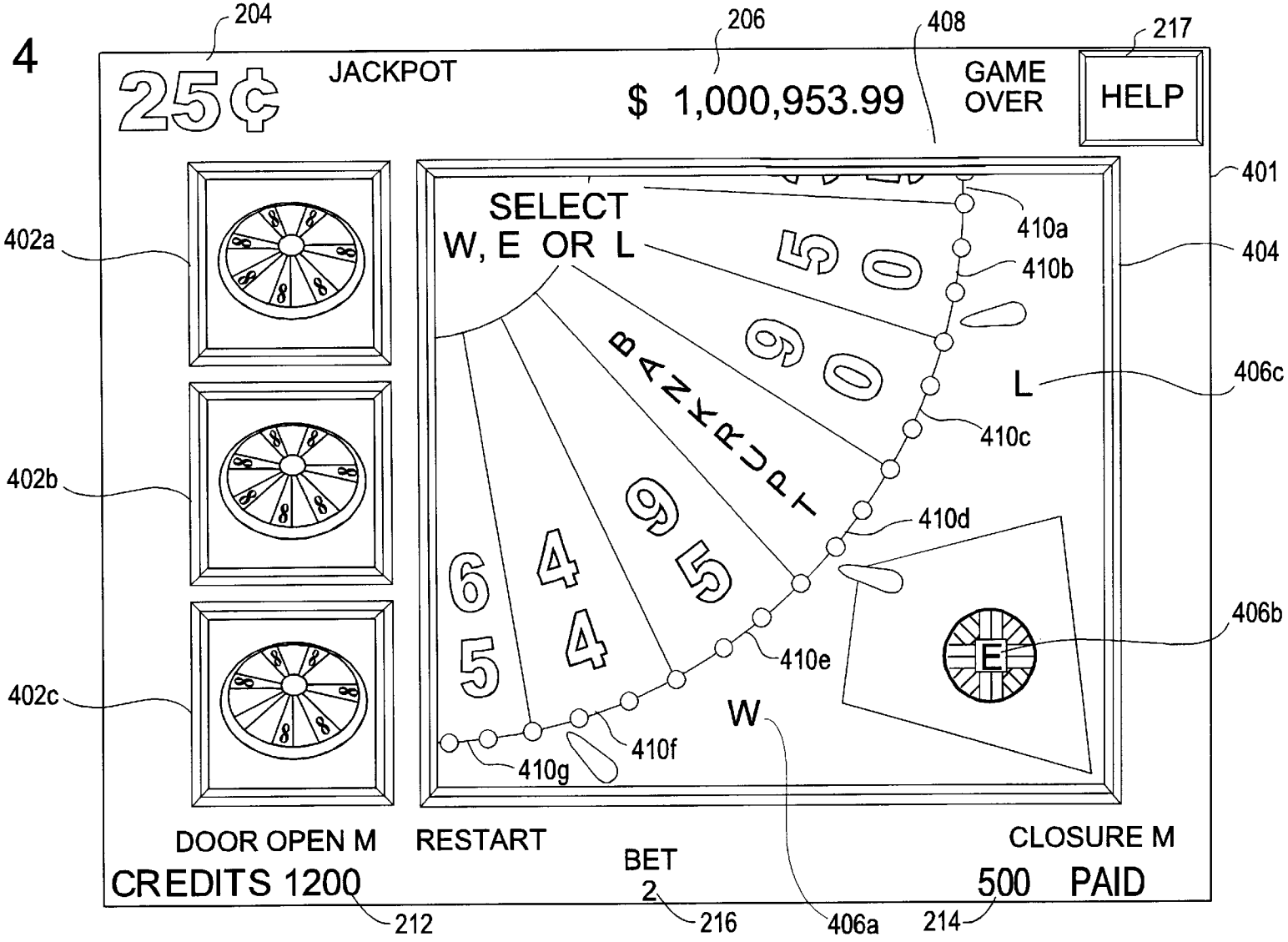
FIG. 4 shows the appearance of a display screen during a third portion of game play according to an embodiment of the present invention.

If the user obtains the result 114 which permits the user to play a wheel game, the wheel screen FIG. 4 will be shown on the display device. In one embodiment, the user may be provided with an opportunity to spin two or more simulated wheels, preferably in a hierarchical fashion, i.e., such that at least a first predetermined result must be achieved on a first wheel in order for the user to be permitted to obtain a simulated spin of the next wheel. In the embodiment of FIG. 4, first, second and third wheel indicia 402*a*, 402*b*, 402*c* can be highlighted or otherwise distinguished to show the user which wheel in the hierarchy is currently being played or spun. In the depicted embodiment, a second portion of the screen 404 shows at least a portion of the simulated wheel which is indicated by the indicia 402, preferably in a magnified view as shown. In one embodiment, there are a plurality of flippers or pointers such as three flippers associated with letters or other indicia 406*a*, 406*b*, 406*c*. In this embodiment, the user is permitted to select (via an input device such as a touch screen) which of the flippers or pointers will be the pointer used to indicate the stop position indicium of the wheel.

In the depicted embodiment the simulated wheel 408 is divided into a plurality of regions, preferably 24 evenly spaced regions. In the embodiment of FIG. 4, only 7 of the 24 regions are shown in the enlarged view at any one time.

Although the wheel 401*a* depicted on the screen 401 is a simulated wheel rather than a physical wheel, the simulated wheel 408 has certain characteristics in common with a real physical wheel of fortune. The major similarities of importance are that a plurality of indicia are associated with the wheel, the stop indicium of the wheel is randomly or pseudo randomly determined and for each indicium there is a bounded or predetermined probability that that indicium will be pointed to by the selected flipper or other indicator when the simulated wheel spin is completed. Preferably the probabilities for each of the indicia can be established independently of the number of or position of the indicia on the simulated wheel.

Figure 5:
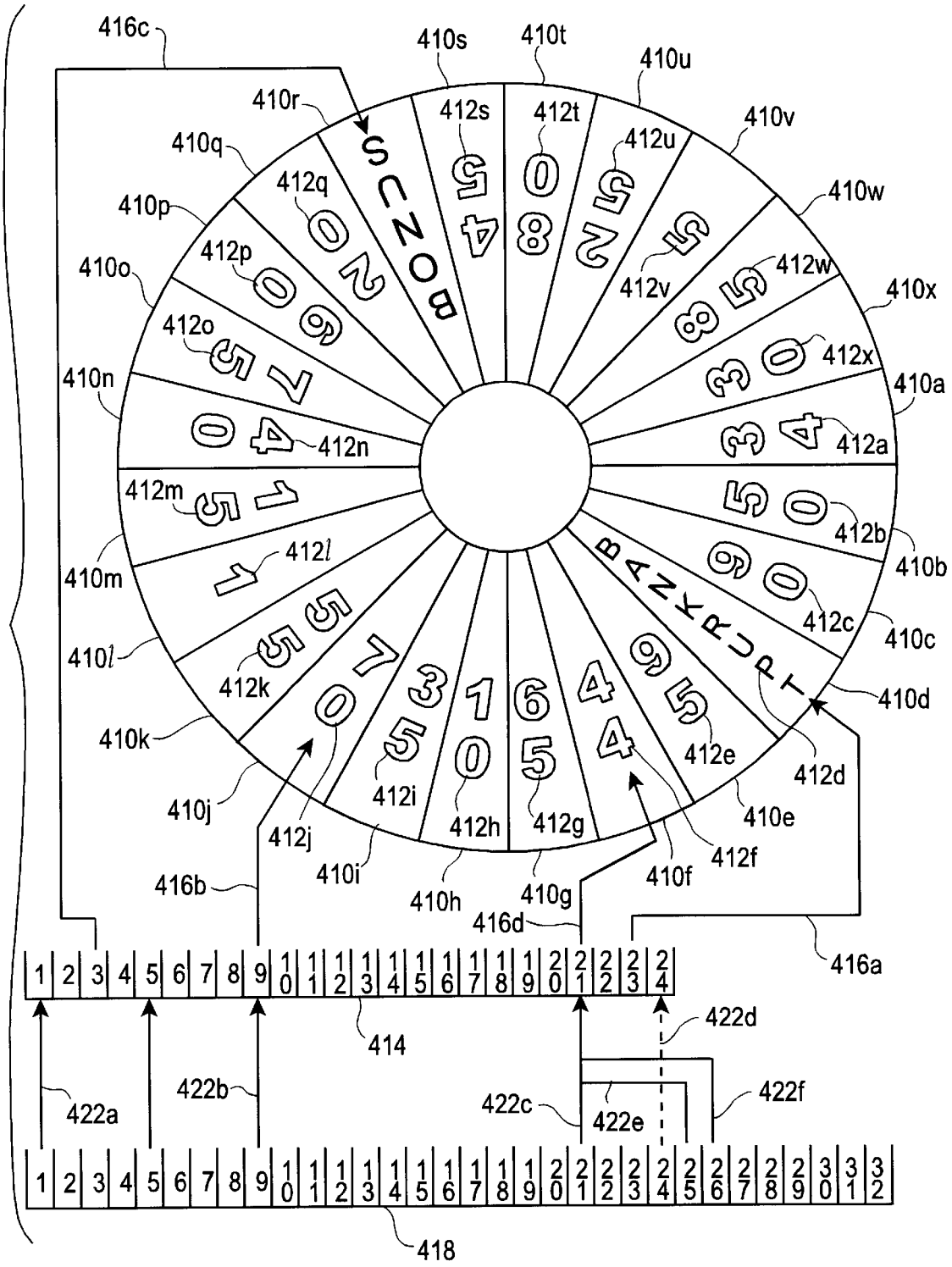
FIG. 5 is a schematic diagram showing an example of integer-to-wheel mapping according to one embodiment of the present invention.

FIG. 5 illustrates one fashion in which this independence can be achieved. As depicted in FIG. 5, in one embodiment a simulated wheel defines 24 regions 410*a*–410*x* each associated with an indicium 412*a*–412*x*. In one embodiment, each of the 24 indicia 412*a*–412*x* is associated with an integer 414 in the range 1–24. In the embodiment depicted in FIG. 5, associations between the integers 414 in the range of 1–24 and the indicia 412 are shown by arrows 416*a*–416*d*. Although 24 arrows would be used to show all of the associations, only four arrows are depicted in FIG. 5 for clarity. The set of all such defined associations form a first mapping. Manners of defining and storing associations or mappings are well known to those of skill in the art. In one embodiment, the mapping is stored in memory as an ordered list with 24 entries, each entry identifying one of the simulated wheel spaces 410. In this embodiment a wheel spin is performed by selecting one of the numbers 414 in the range 1–24 preferably as described below, controlling the display 401 to simulate the appearance of the wheel 408 as it would appear if it were spinning and simulating the slowing down and stopping of the wheel so that the selected flipper 406 points to a region 410 bearing the indicium 412 which corresponds with the selected one of the integers 414.

If it were desired to provide the game in which the odds of landing on any one of the 24 indicia was exactly 1:24, then it would be possible to achieve this such odds by randomly selecting one of the integers 414. In one embodiment, however, it is desired to have odds which are different from, preferably larger than, 1:N where N is the number of indicia shown on the simulated wheel at any one time. One manner of achieving such a result is to define a second set of integers 418 in the range 1–M where M may be different from M such as integers 1–32. Each of the second set of integers 418 is associated with or mapped onto an integer in the first group of integers 414, as shown by arrows 422*a*–422*f*. Although 32 arrows would be needed to show the full mapping or association, only six arrows are shown for purposes of clarity. Because N, the number integers in the first group 414, is smaller than M, the number of integers in the second group 418, it will be necessary for at least one of the integers in the first group 414 to be associated with more than one of the integers in the second group 418. The mapping or association can be done in any of a number of fashions as long as for every integer in the second group 418 there is an associated integer in the first group 414 which is associated with an indicium of the wheel 412. For example, the depicted embodiment integer 21 in the first group 414 is associated with 422*c*, 422*e*, 422*f*, three integers (21, 25, 26) from the second group 418. In this configuration, the computer can be programmed to randomly select an integer between 1 and 32 which is mapped onto one of the indicia 412*g* via the mapping 422 onto the integers 1–24. Several features should be noted in this regard. For an indicium 412 which is associated with a member of the first group 414 that is associated with only a single integer from the second group 418, the odds of landing on that indicium on any one spin will be 1:M. For an indicium such as 412*f* which is associated with an integer (e.g., integer 21) in the second group 414 that is associated (422*c*, 422*e*, 422*f*) with three integers (21, 25, 26) of the second group 418, the odds of landing on that indicium 412*f* will be 1:3M.

If wheel 408 is a simulated rather than a physical wheel, it is possible to modify or replace the indicium 412 associated with a region 410, merely by appropriate programming instructions. Thus, even when it is desired to have no more than a maximum number (such as 24) of regions 410 on the simulated wheel (e.g., to provide for sufficient size and clarity of the indicia on the screen) it is possible for the simulated wheel to display more than 24 indicia, not all at the same time. For example, in the embodiment depicted in FIGS. 4 and 5, region 410*g* is associated with the indicium "65" 412*g*. In one embodiment, in the display screen (FIG. 4) is controlled to simulate clockwise spinning of the wheel 408. After the view depicted in FIG. 4, the region 410*g* will move out of view as region 410*a*(and then 410*x*) moves into view. After region 410*g* has moved out of view, indicium 412*g* could be replaced by a new, 25th indicium which would be shown on the screen when region 410*g* reappears on the enlarged view 404 during the next revolution of the wheel 408. Thus it is possible in the present embodiment to provide for a number of indicia 412 on the wheel which is greater than the number of regions 410 defined for displaying the indicia at any one time.

Figure 6:
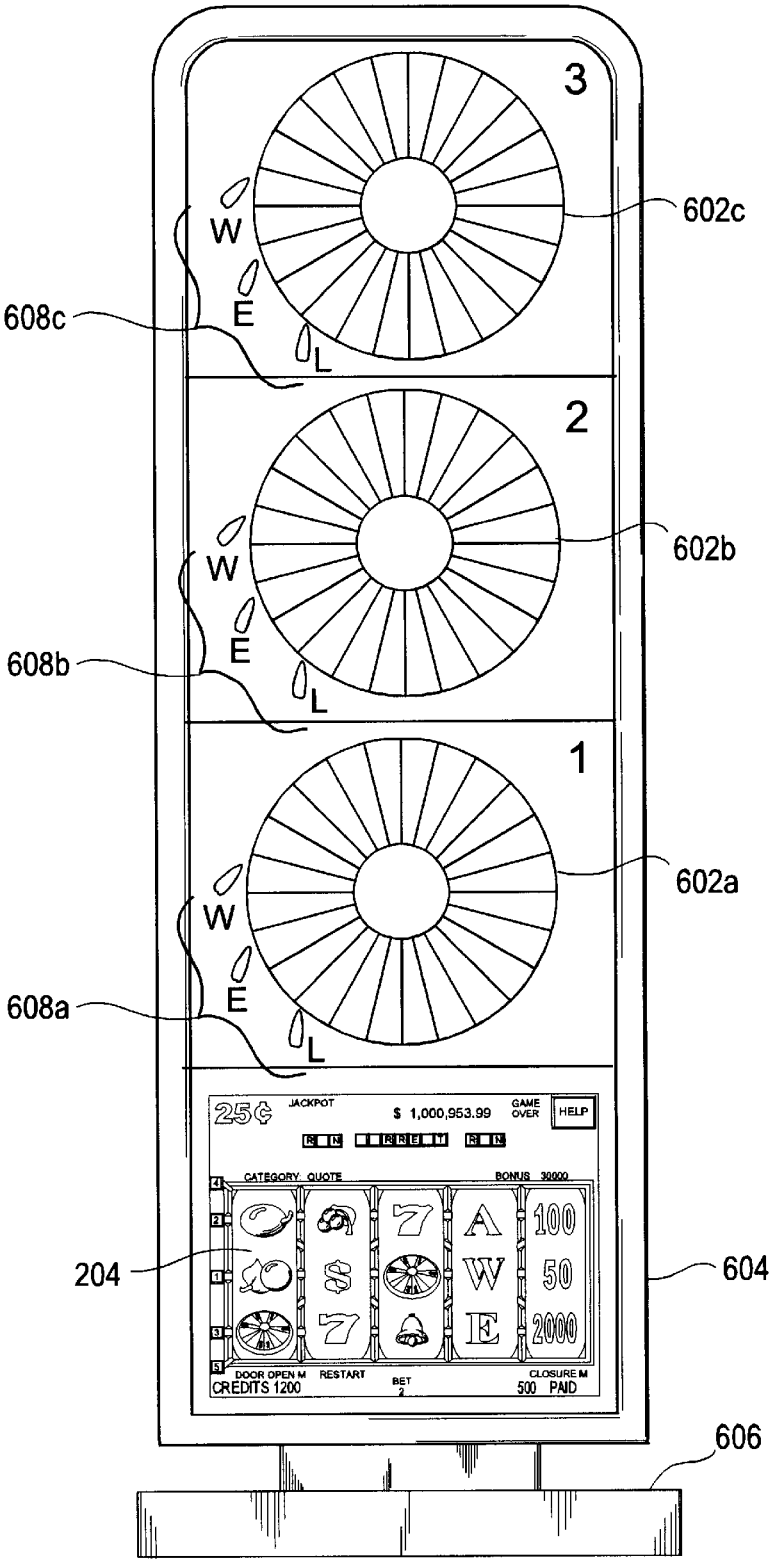
FIG. 6 shows the appearance of a device in an embodiment of the invention using physical wheels with associated virtual wheels.

It should be noted that although the use of simulated video wheels is preferred in some embodiments, it is possible to implement the invention using at least one physical wheel having one or more associated virtual wheels. Video wheels are preferred because of the ease with which they can be altered. In addition, they can be implemented less expensively since no extra hardware is required. However, physical wheels such as those shown in FIG. 6 could be incorporated into a machine to provide a similar level of excitement to the video wheels. As shown in FIG. 6, the same main screen 204 is used. Instead of having extra screens displaying video wheels 402, a set of physical wheels 602*a*–*c* is affixed to the top of cabinet 604 containing main screen 204. Cabinet 604 is set atop base 606. The play of the embodiment incorporating physical wheels 602 is the same as described above with respect to the video wheels, with the only difference being that instead of bonus screens being displayed with the video wheels, play on the physical wheels is substituted when the required events occur. For example, when the user obtains the result 114, the wheel game is activated. The user is then entitled to a wheel spin on first wheel 602*a*. If a predetermined result is achieved on first wheel 602*a* upon completion of the spin, the user is entitled to a spin on second wheel 602*b*. Finally, if a predetermined result is achieved upon the completion of the spin of second wheel 602*b*, the user is entitled to a spin on third wheel 602*c*. Flippers 608*a*–*c* for each wheel, similar to those depicted on the simulated video wheels, are positioned on the physical wheels 602*a*–*c* to determine the selected position after the spin is completed.

In an embodiment in accordance with FIG. 6, it is also possible to replace main screen 204 with physical spinning reels as used in standard slot machines. An example of a standard slot is one that is manufactured by International Game Technology of Reno, Nev.

Returning to FIG. 1, when the user reaches the wheel game depicted in FIG. 4, the large view of the wheel is displayed 404 the indicium 402*a* corresponding to the wheel which is being spun, wheel number 1, is highlighted, the user selects one of the flippers 406*a*, 406*b*, 406*c* and a simulated wheel spin is displayed. The wheel stops so that the selected flipper 406 points to a randomly or pseudo-randomly selected indicium (selected as described above) 132. Preferably, one of the indicia 412*d* is a "bankrupt" or other losing indicium and if the selected flipper 406*b* points to this indicium, play returns to the beginning of the game 112.

If it is determined that the indicium pointed at by the selected flipper 406 is not a losing indicium, it is next determined whether the selected flipper 406 points to a bonus indicium 412. Although in the embodiment in FIG. 5, only a single bankrupt indicium and a single bonus indicium is depicted, a wheel may be provided with more or fewer bankrupt and/or bonus indicia.

Preferably, indicia which are not "bankrupt" or "bonus" are associated with a numerical value 412*a*, 412*b*, 412*c*, 412*e*–412*q*, 412*s*–412*x*. If the wheel lands on neither the bonus nor bankrupt indicium, the bonus value 210 is preferably incremented by the amount associated with the indicium 412 times the number of coins played 216 and the procedure then returns to the beginning 112.

If the wheel landed on a bonus indicium 136, the second wheel indicium 402*b* is highlighted and the player is provided with a spin of the second wheel. In one embodiment, the second wheel is similar to the first wheel but preferably does not contain a bankrupt indicium 412*d* and preferably contains indicium values 412 which are larger than (such as twice) the amount of the first wheel values. Thus, after reaching the second wheel spin, the second wheel indicium 412*b* is highlighted, user selects a flipper 406 and the simulated wheel spin is displayed 142. If the wheel does not land on a bonus indicium 412*r*, the bonus value 210 is incremented 146 by the amount of the bonus indicium on the second wheel times the number of coins bet 216 and play then returns to the beginning 112.

If the second wheel resulted in a bonus indicium 412*r*, the wheel number three indicator 402*c* is highlighted, the user selects a flipper 406 and simulated spin at the third wheel is displayed. Preferably the third wheel has no bankrupt indicium 412*d* and the values associated with the indicia 412 are larger (such as 10 times) those on the first wheel. If the player does not land on the bonus indicium 412*r* of the third wheel, the bonus is incremented by the wheel amount times the number of coins played 216 and the player receives a payout equal to the amount of the indicium 412 pointed to by the selected flipper 406 times the number of coins bet 216. If the player lands on a bonus indicium 412*r* on the third wheel spin it is determined 162 whether the player had bet the maximum number of coins (MAX) 216. If not, the player is paid some multiple of the number of coins bet 216, such as 10,000 times the number of coins bet 164. If the player has bet the maximum number of coins 216 the player is awarded a top award jackpot prize 206 166. In either case, player then returns to the beginning 112.

The game may be set up as a stand alone machine capable of paying out set prize values for winning combinations on pay lines 228*a*–*e* for reels 226*a*–*e*, or a particular selected wheel portion 410 during respective portions of the game process. The top award jackpot prize may also be a set value that is the more than any other prize. However, in a preferred embodiment of the invention, the top award jackpot prize is a progressive value that increases an amount for each coin deposited in the machine. Such a value 206 is shown on main display screen 204. The progressive machine may be operated as a stand alone unit, or preferably in a linked manner to other similar games throughout a particular gaming jurisdiction. For example, if 1000 machines are linked together such that a portion of each coin deposited in each machine increases the top award jackpot prize amount by as a function of the coin in for each machine, the top prize is capable of reaching figures in the millions of dollars. Linked progressive systems of this type are known in the gaming industry such as International Game Technology's Megabucks® that has reached top award jackpot prizes of more than $10 million.

In one embodiment, a first game portion provides a 1:50 chance of having an opportunity to spin a first wheel, the first wheel provides a 1:20 chance of having an opportunity at a second wheel, a second wheel provides a 1:40 chance of having an opportunity at a third wheel, and a third wheel provides a 1:200 chance of winning a jackpot to achieve overall odds (i.e., the product of the odds for all game portions) of 1:8,000,000 to win the jackpot in game having three wheel spins. 1:8,000,000 is obtained by multiplying the combined odds, i.e. 50×20×40×200=8,000,000. The overall odds for the jackpot can be adjusted in a number of ways, e.g., by changing the number of wheel spins involved in winning the jackpot, and/or by changing the odds of any particular wheel spin giving an opportunity at the next wheel in the hierarchy (such as by adjusting the mapping from the range of integers to the simulated wheel indicia).

In light of the above description, a number of advantages of the present invention can be seen. The present invention provides a game which includes aspects of the familiar Wheel of Fortune game which is attractive to many players but which overcomes some of the limitations of a traditional wheel of fortune game. The present invention can provide a value wheel without the need for undesirable dimensional increases in the main housing. The present invention facilitates changes in, e.g., the theme or operation of the game without the need to modify the win/loss determination procedures. The present invention achieves 1:K odds of landing on a jackpot—winning indicium of the simulated wheel where K is greater then the total number of indicia on the wheel, K is preferably a large number such as 1,000,000 preferably 5,000,000 and more preferably 8,000,000 or more. In one embodiment a mapping between groups of integers is provided such that the odds of landing on any one indicium are different from 1:J where J is the number of indicia (preferably evenly spaced indicia) on the simulated wheel. In one embodiment, odds of winning a grand prize or jackpot are adjusted by providing a game in which spins of several different wheels are provided and wherein the wheels are hierarchically related such that the results of a spin of one wheel affect the either ability to spin or the results from a spin of a succeeding wheel.

A number of variations and modifications can also be used. Although the present disclosure describes an embodiment having three wheel spins in a hierarchy, it is also possible to provide more or fewer wheel spins in a multiple wheel hierarchy. Although in one described embodiment, each wheel in the hierarchy is different (such as having different values associated with the indicia and/or different odds of landing on a bonus indicium) an embodiment could be provided in which all wheels provide identical values, indicia and/or odds or different virtual wheels can be assigned to the same simulated or physical wheel depending on the level of the hierarchy a player attains. In addition, although the above described embodiment provides for a first slot machine/phrase completion game combined with the wheel game, it is possible to combine a value wheel with other types of games such as a keno game, a blackjack game, a poker game and the like, or to provide a game which is strictly a hierarchy of wheels or a single wheel, without combining with a game of another type. Further, it is possible to implement the invention in other ways by displaying ranges of indicia without the use of a wheel. For example, a line of values could be displayed and an indicator arrow could move along the line. The movement could be back and forth along the line or with the use of a wrap-around effect upon reaching the end of the line.

Although the invention has been described by way of a preferred embodiment and certain variations of modifications, other variations and modifications can also be used, if the invention being defined by the following the claims.

What is claimed is:

1. A computer implemented game process comprising:

controlling a first display device housed in a first housing to display an image of a plurality of indicia using a first controller coupled to said first display device, said image, during at least a first period of said display, including at least one indicium designated as a next level indicium; and upon the next level indicium being selected during the first period, controlling a second display using a second controller coupled to said second display device to simulate selection of an indicium from a second plurality of indicia;

wherein said second display is in a second housing different from and spaced from said first housing.

2. A process as claimed in claim 1 wherein said step of controlling said second display includes controlling said second display to display at least a portion of a value wheel.

3. A process as claimed in claim 2 wherein said value wheel is positioned above said first housing.

4. A process as claimed in claim 2 wherein said value wheel is a physical wheel rotatable about a rotation axis.

5. A process as claimed in claim 2 wherein said value wheel is an electronically controlled video display of a wheel.

6. A process as claimed in claim 1 wherein said first display is controlled in response to first software associated with said first controller, said first software including at least first game win/loss determination procedures;

wherein said second display is controlled in response to second software associated with said second controller; and wherein said second software is configured such that said second display can be changed by changing said second software, substantially without modification of said first game win/loss determination procedures.

7. Apparatus for gaming comprising:

a first display device housed in a first housing;

a first controller coupled to said first display device to display an image of a plurality of indicia, said image, during at least a first period of said display, including at least one indicium designated as a next level indicium;

a second display device housed in a second housing different from and spaced from said first housing;

a second controller, separate from said first controller, coupled to said second display, configured to, upon the next level indicium being selected during the first period, control said second display to simulate selection of an indicium from a second plurality of indicia.

8. Apparatus as claimed in claim 7 wherein said step of controlling said second display includes controlling said second display to display at least a portion of a value wheel.

9. Apparatus as claimed in claim 8 wherein said value wheel is positioned above said first housing.

10. Apparatus for gaming comprising:

first display means housed in a first housing;

means coupled to said first display means for controlling said first display means to display an image of a plurality of indicia, said image, during at least a first period of said display, including at least one indicium designated as a next level indicium;

second display means housed in a housing different from and spaced from said first housing for displaying a second plurality of indicia;

means coupled to said second display, distinct from said means coupled to said first display means for controlling said second display to simulate selection of an indicium from said second plurality of indicia upon the next level indicium being selected during the first period.

11. Gaming apparatus comprising:

an array of N gaming terminal housings, each housing having a first computer-implemented control for playing a first game portion involving receiving wagers and providing a win/loss first game portion outcome wherein N is greater than 1, and wherein N is an integer value;

M value wheel display means each display means having a second computer-implemented control for playing a second game portion, spaced from said gaming terminal housings, and configured to display at least a second game portion outcome, different from said first game portion outcome wherein M is an integer value.

12. Gaming apparatus as claimed in claim 11 wherein M is greater than 1.

13. Gaming apparatus as claimed in claim 11 wherein said value wheel display means are positioned in the absence of a direct structural connection to said N gaming terminal housings.

14. Gaming apparatus as claimed in claim 11 wherein said value wheel display means are positioned above said N gaming terminal housings.

15. Gaming apparatus as claimed in claim 11 wherein M is equal in value to N and wherein each value wheel display means is positioned substantially above and aligned with a corresponding one of said gaming terminal housings.

16. Gaming apparatus as claimed in claim 15 wherein said computer-implemented control is configured to provide at least a first output for use in controlling said second game portion outcome.

17. Gaming apparatus comprising:

an array of N gaming terminals housings, each housing having a first computer-implemented control for playing a first game portion involving receiving wagers and providing a win/loss first game portion outcome wherein N is greater than 1;

M value wheel display devices each display device having a second computer-implemented control for playing a second game portion, spaced from said gaming terminal housings, and configured to display at least a second game portion outcome, different from said first game portion outcome wherein M is greater than 1.

18. Gaming apparatus as claimed in claim 17 wherein M is equal to N and wherein each value wheel display means is positioned substantially above and aligned with a corresponding one of said gaming terminal housings.

19. A gaming method comprising:

providing a plurality of gaming terminal housings, each housing having a first computer-implemented control for playing a first game portion involving receiving wagers and providing a win/loss first game portion outcome;

positioning a plurality of value wheel display devices, each display device having a second computer-implemented control for playing a second game portion and each value wheel display device substantially aligned with and spaced from a corresponding one of said gaming terminal housings, and configured to display at least a second game portion outcome, different from said first game portion outcome.

* * * * *

UNITED STATES PATENT AND TRADEMARK OFFICE

CERTIFICATE OF CORRECTION

PATENT NO. : 6,162,121
DATED : December 19, 2000
INVENTOR(S) : Morro et al.

It is certified that error appears in the above-identified patent and that said Letters Patent is hereby corrected as shown below:

Column 15,
Line 67, after second occurance of “means” insert -- , --.

Column 16,
Line 12, after “means” insert -- , --.
Line 17, after “outcome” insert -- , --.
Line 41, after “devices” insert -- , --.
Line 59, after “portion” insert -- , --.

Signed and Sealed this

Eleventh Day of February, 2003

JAMES E. ROGAN
*Director of the United States Patent and Trademark Office*